US012064037B2

(12) United States Patent
Horst et al.

(10) Patent No.: US 12,064,037 B2
(45) **Date of Patent: *Aug. 20, 2024**

(54) BASSINET

(71) Applicant: Wonderland Switzerland AG, Steinhausen (CH)

(72) Inventors: Andrew J. Horst, West Lawn, PA (US); Patrick J. G. Bowers, Morgantown, PA (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 472 days.

This patent is subject to a terminal disclaimer.

(21) Appl. No.: 17/381,208

(22) Filed: Jul. 21, 2021

(65) Prior Publication Data

US 2021/0345791 A1 Nov. 11, 2021

Related U.S. Application Data

(62) Division of application No. 16/102,752, filed on Aug. 14, 2018, now Pat. No. 11,103,089.

(60) Provisional application No. 62/545,680, filed on Aug. 15, 2017.

(51) Int. Cl.

| | |
|---|---|
| ***A47D 11/00*** | (2006.01) |
| ***A47D 9/00*** | (2006.01) |
| ***A47D 13/06*** | (2006.01) |

(52) U.S. Cl.

CPC ..... *A47D 11/005* (2013.01); *A47D 9/012* (2022.08); *A47D 9/016* (2022.08); *A47D 13/063* (2013.01)

(58) Field of Classification Search

None

See application file for complete search history.

(56) References Cited

U.S. PATENT DOCUMENTS

| | | | | |
|---|---|---|---|---|
| 5,349,709 | A | 9/1994 | Cheng | |
| 5,553,336 | A | 9/1996 | Mariol | |
| 6,418,575 | B1 | 7/2002 | Cheng | |
| 6,698,698 | B1 | 3/2004 | Hsieh | |
| 6,728,980 | B1 * | 5/2004 | Chen | A47D 9/016 5/93.1 |

(Continued)

FOREIGN PATENT DOCUMENTS

| | | |
|---|---|---|
| CN | 101361627 A | 2/2009 |
| CN | 101835411 A | 9/2010 |
| CN | 104886983 A | 9/2015 |

*Primary Examiner* — Adam C Ortiz

(74) *Attorney, Agent, or Firm* — Winston Hsu

(57) ABSTRACT

A bassinet includes a main frame, a bassinet frame and a height adjusting assembly. The bassinet frame is detachably installed on the main frame and slidably installed on the main frame by a sliding track of the height adjusting assembly. The bassinet frame is vertically movable between a first position and a second position. When the bassinet frame is located at the first position, a supporting surface of the bassinet frame is located in close proximity to a top surface of the main frame, so that the bassinet provides an unhindered view of a child in the bassinet frame. The bassinet can be used as a normal bassinet when the bassinet frame is located at the second position. The main frame and the bassinet frame can be used as a standard play yard and a stand-alone bassinet when the bassinet frame is detached from the main frame.

5 Claims, 12 Drawing Sheets

(56) References Cited

U.S. PATENT DOCUMENTS

| | | | | |
|---|---|---|---|---|
| 7,967,261 | B2 | 6/2011 | Wilcox | |
| 11,103,089 | B2 * | 8/2021 | Horst | A47D 13/063 |
| 2009/0188039 | A1 * | 7/2009 | Shan | A47D 9/016 5/93.1 |
| 2011/0197358 | A1 | 8/2011 | Bu | |
| 2012/0017369 | A1 | 1/2012 | Li | |
| 2015/0173523 | A1 | 6/2015 | Horst | |
| 2016/0286979 | A1 | 10/2016 | Sclare | |

* cited by examiner

BASSINET

CROSS REFERENCE TO RELATED APPLICATIONS

This is a divisional application of U.S. patent application Ser. No. 16/102,752, filed on Aug. 14, 2018, which claims the benefit of U.S. Provisional Application No. 62/545,680, filed on Aug. 15, 2017, and the entire contents of this application are hereby incorporated by reference.

BACKGROUND OF THE INVENTION

1. Field of the Invention

The present invention relates to a child product, and more particularly to a bassinet capable of providing an unhindered view of a child within and being switched between different using states.

2. Description of the Prior Art

In order for caregivers to take care of their children, a number of child products are employed. A bassinet is usually constructed of a frame and an evaluated sleeping surface for allowing a caregiver to have easy access to the child. However, the evaluated sleeping surface of the conventional bassinet is configured to be below a top surface of the frame, and therefore, a view of the child is sometimes obstructed by the frame and soft goods thereon. Furthermore, some caregivers may move the bassinet close to their bed to have a clear view of the child without leaving their bed. However, it causes a potential safety hazard as pillows and bedding may fall into the bassinet.

SUMMARY OF THE INVENTION

Therefore, it is an objective of the present invention to provide a bassinet capable of providing an unhindered view of a child within and being switched between different using states for solving the aforementioned problems.

In order to achieve the aforementioned objective, the present invention discloses a bassinet. The bassinet includes a main frame, a bassinet frame and a height adjusting assembly. The main frame includes a top surface. The bassinet frame is detachably installed on the main frame. The bassinet frame is vertically movable between a first position and a second position relative to the main frame. The bassinet frame includes a supporting surface for supporting a child. The supporting surface of the bassinet frame is adjacent to the top surface of the main frame and spaced from the top surface of the main frame at a first distance when the bassinet frame is located at the first position relative to the main frame. The supporting surface of the bassinet frame is below the top surface of the main frame and spaced from the top surface of the main frame at a second distance greater than the first distance when the bassinet frame is located at the second position relative to the main frame. The height adjusting assembly includes at least one sliding track disposed on the bassinet frame. The bassinet frame is slidably installed on the main frame by the at least one sliding track, so that the bassinet frame is allowed to slide between the first position and the second position relative to the main frame.

According to an embodiment of the present invention, the bassinet further includes at least one locking mechanism for positioning the bassinet frame at the first position or the second position.

In summary, the bassinet of the present invention can be switched between different using states by moving the bassinet frame relative to the main frame between the first position and the second position or detaching the bassinet frame from the main frame. When the bassinet frame is located at the first position, the supporting surface of the bassinet frame is adjacent to the top surface of the main frame, so that the bassinet provides an unhindered view of a child in the bassinet frame. Furthermore, the bassinet can be used as a normal bassinet when the bassinet frame is located at the second position. Besides, the main frame and the bassinet frame can be used as a standard play yard and a stand-alone bassinet when the bassinet frame is detached from the main frame. Therefore, the bassinet of the present invention has multiple purposes.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
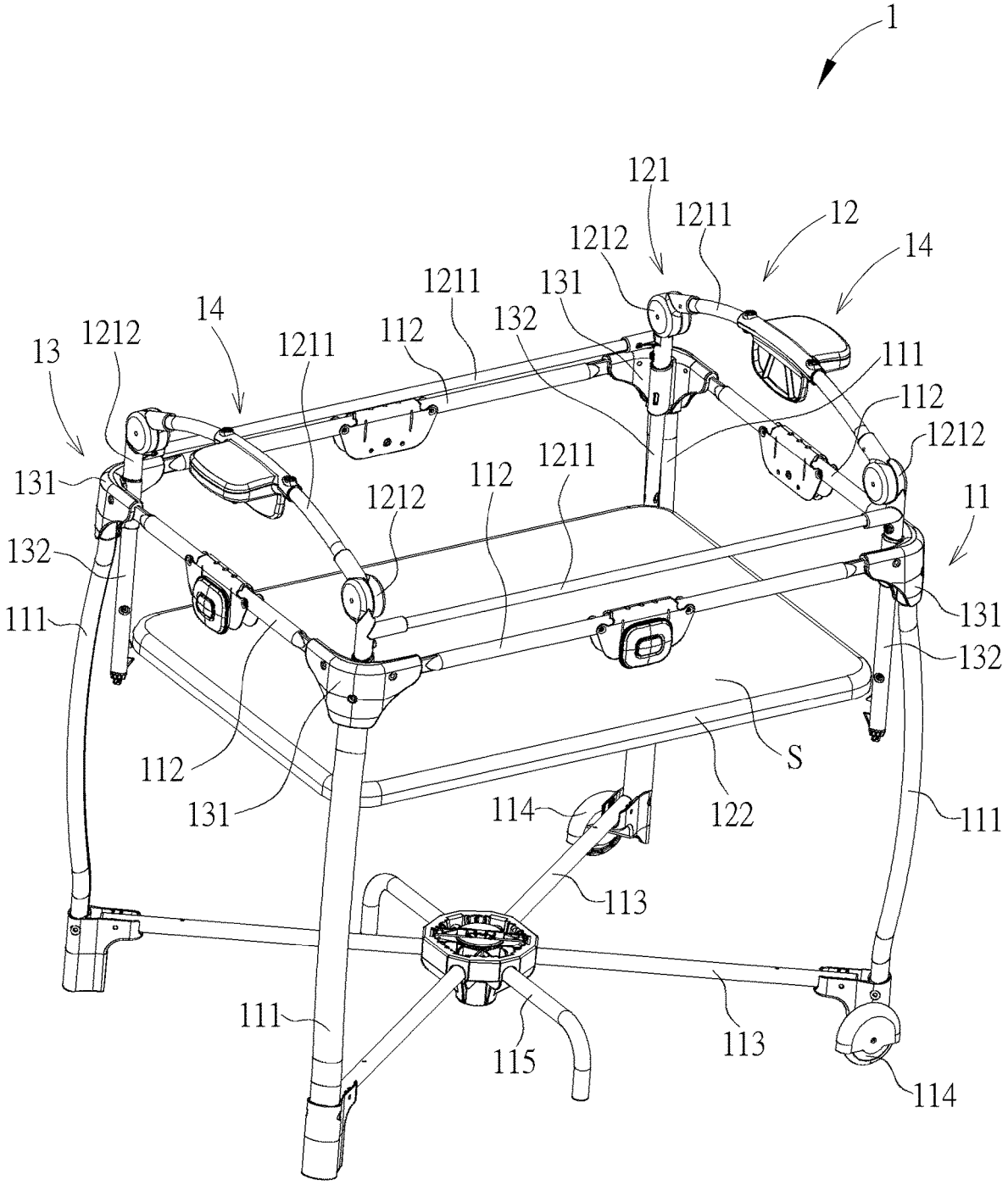
FIG. 1 is a schematic diagram of a bassinet according to a first embodiment of the present invention.

Please refer to FIG. 1. FIG. 1 is a schematic diagram of a bassinet 1 according to a first embodiment of the present invention. As shown in FIG. 1, the bassinet 1 includes a main frame 11, a bassinet frame 12, a height adjusting assembly 13 and two locking mechanisms 14. The bassinet frame 12 is detachably and slidably installed on the main frame 11 by the height adjusting assembly 13, so that the bassinet frame 12 is vertically movable relative to the main frame 11. The two locking mechanisms 14 are disposed two opposite sides of the bassinet frame 12 for positioning the bassinet frame 12 relative to the main frame 11.

Specifically, in this embodiment, the main frame 11 includes four vertical main tubes 111, four horizontal upper main tubes 112, two horizontal lower main tubes 113, two wheels 114 and a supporting leg 115. The two wheels 114 are rotatably disposed on two lower ends of the two vertical main tubes 111 at the right side. Each horizontal upper main tube 112 is connected to two upper ends of the two adjacent vertical main tubes 111. Each horizontal lower main tube 113 is connected to two lower ends of the two diagonal vertical main tubes 111. The supporting leg 115 is disposed at a joint of the two horizontal lower main tubes 113 for supporting the main frame 11 on the ground.

Furthermore, the bassinet frame 12 includes an upper bassinet mounting assembly 121 and a lower mounting component 122 disposed opposite to the upper bassinet mounting assembly 121. The lower mounting component 122 has a supporting surface S for supporting a child thereon. The upper bassinet mounting assembly 121 can be connected to the lower mounting component 122 by soft goods, which is not shown in the figures. However, it is not limited thereto. The upper bassinet mounting assembly 121 also can be connected to the lower mounting component 122 by other means. The upper bassinet mounting assembly 121 includes four upper bassinet tubes 1211 and four sleeve components 1212. Each sleeve component 1212 is connected to the two adjacent upper bassinet tubes 1211. The height adjusting assembly 13 includes four sockets 131 and four vertical tubes 132. Each vertical tube 132 is connected to the corresponding sleeve component 1212. Each socket 131 is connected to the two adjacent horizontal upper main tubes 112 and the corresponding vertical main tube 111. That is, in this embodiment, the four sockets 131 are located at four corners of the main frame 11, and the four sleeve components 1212 are located at four corners of the upper bassinet mounting assembly 121 and corresponding to the four sockets 131. Therefore, the bassinet frame 12 can be installed on the main frame 11 bypassing the four vertical tubes 132 through the four sockets 131. In this embodiment, a through hole of each socket 131 for allowing the corresponding vertical tube 132 to pass therethrough can be located on an inner surface of the corresponding corner of the main frame 11. However, the configuration of the socket is not limited to this embodiment. In another embodiment, the through hole of the socket 131 also can be located on an outer surface of the corner of the main frame 11 or through the vertical main tube 111.

Figure 2:
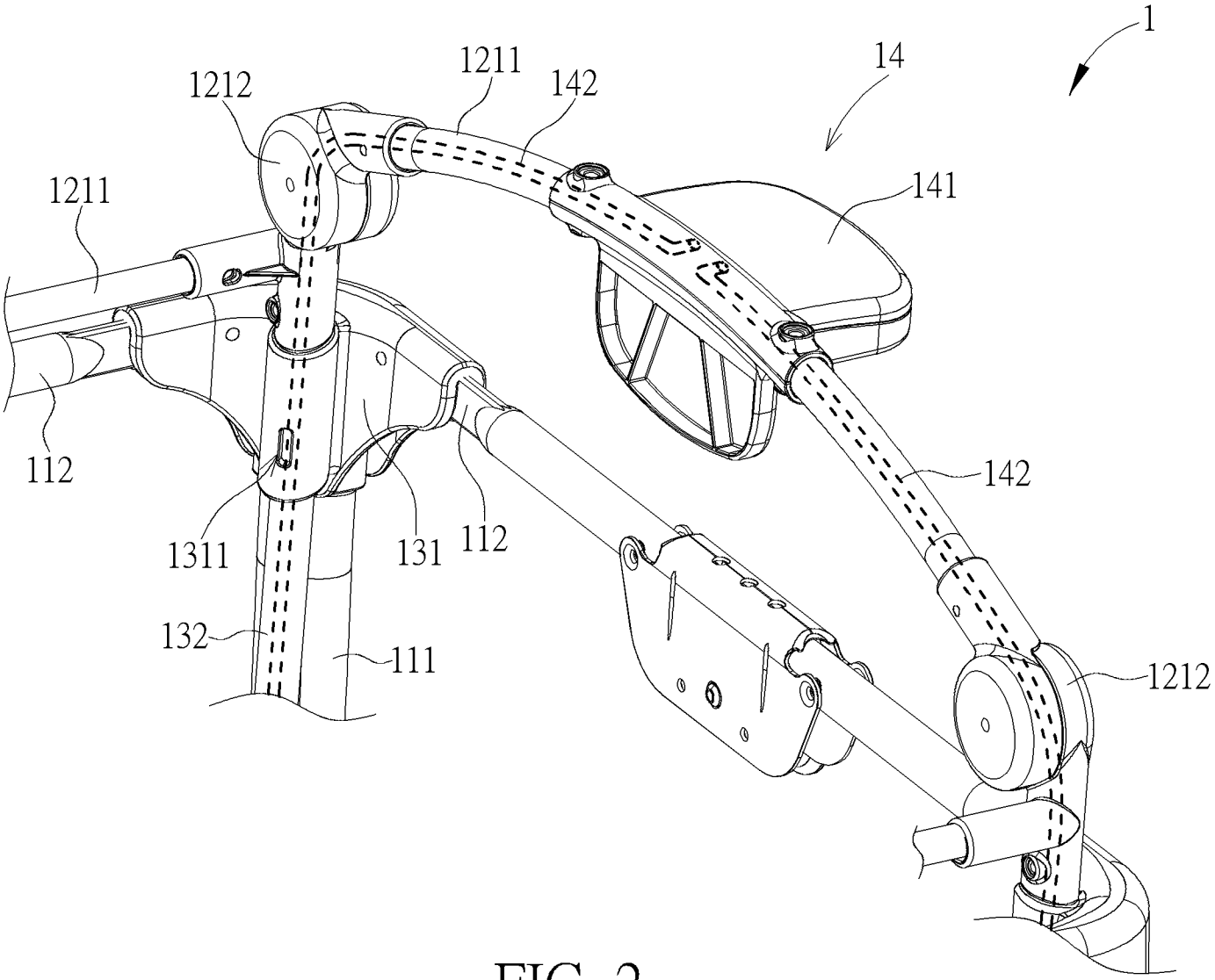
FIG. 2 and FIG. 3 are partial diagrams of the bassinet at different views according to the first embodiment of the present invention.
Figure 3:
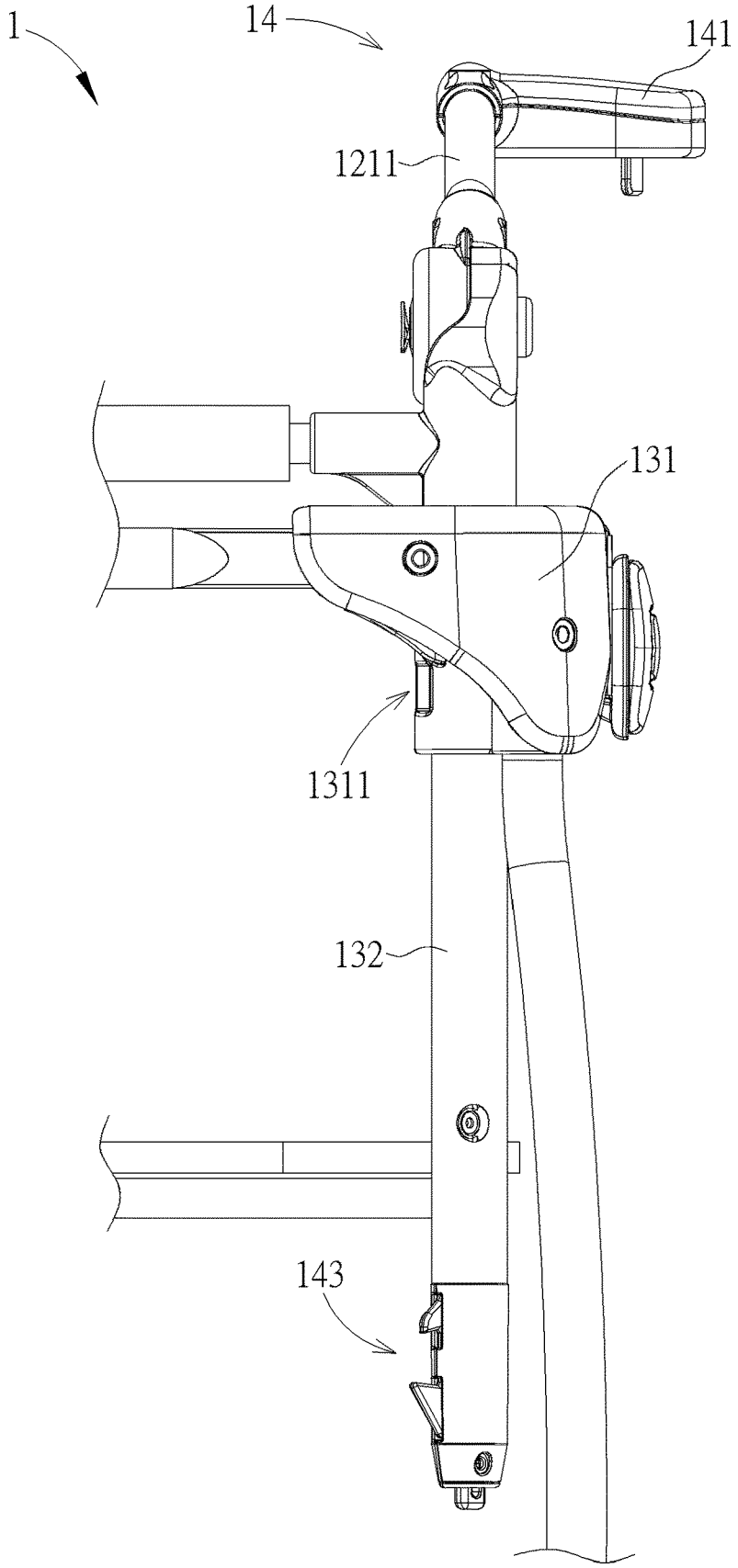
Figure 4:
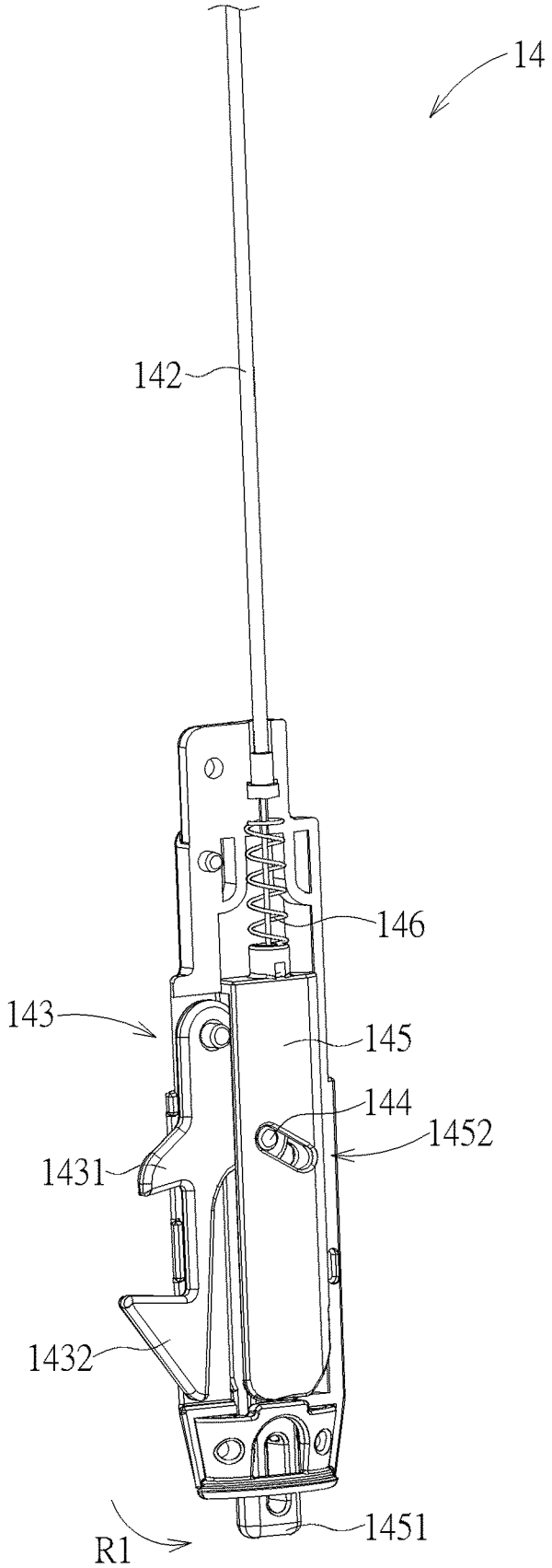
FIGS. 4 and 5 are diagrams of a locking mechanism in different state according to the first embodiment of the present invention.
Figure 5:
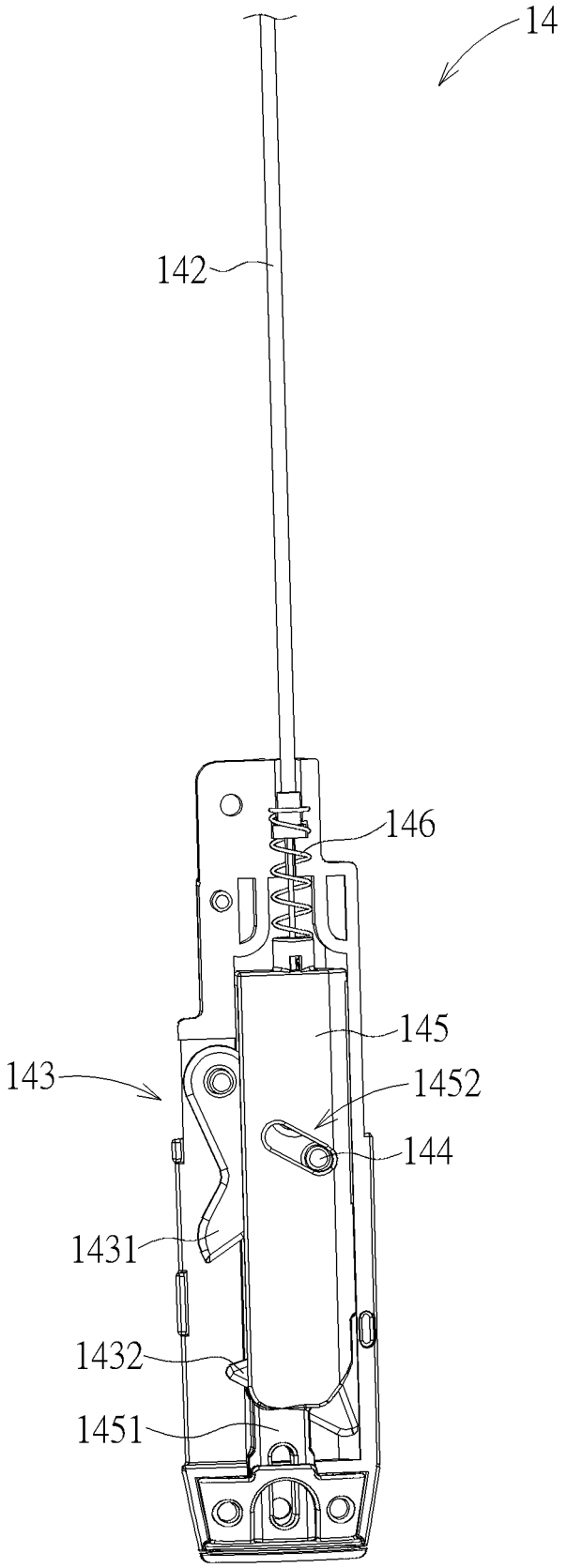

Please refer to FIG. 2 to FIG. 5. FIG. 2 and FIG. 3 are partial diagrams of the bassinet 1 at different views according to the first embodiment of the present invention. FIGS. 4 and 5 are diagrams of the locking mechanism 14 in different states according to the first embodiment of the present invention. The two locking mechanisms 14 at two opposite sides of the bassinet frame 12 can have the same structure and configuration. For simplicity, the locking mechanism 14 at one side of the bassinet frame 12 is introduced as follows. As shown in FIG. 2 and FIG. 3, each locking mechanism 14 includes an operating component 141, two linking components 142, two engaging components 143, two pin components 144, two plunger components 145 and two recovering components 146. The recovering component 146 can be a spring. The operating component 141 is disposed on the corresponding upper bassinet tube 1211. Each engaging component 143 is movably installed inside the corresponding vertical tube 132 for engaging with the corresponding socket 131.

Preferably, in this embodiment, each socket 131 can be an enclosed structure, and an engaging hole 1311 can be formed on each socket 131. Each vertical tube 132 passes though the corresponding socket 131. Each engaging component 143 can be pivoted to the corresponding vertical tube 132 and include a first engaging portion 1431 for engaging with the engaging hole 1311 and a second engaging portion 1432 spaced from the first engaging portion 1431 for abutting against the lower end of the corresponding vertical tube 132.

Each plunger component 145 is movably disposed inside the corresponding vertical tube 132 and includes an abutting end 1451 protruding from a lower end of the corresponding vertical tube 132 for abutting the ground. An inclined slot 1452 is formed on each plunger component 145. Each pin component 144 is disposed on the corresponding engaging component 143 and slidably passes through the corresponding inclined slot 1452. Each linking component 142 passes through the corresponding upper bassinet tube 1211 and the corresponding vertical tube 132 and is connected to the corresponding operating component 141 and the corresponding plunger component 145 for driving the corresponding plunger component 145 by operating the corresponding operating component 141 so as to rotatably retract the corresponding engaging component 143 into the corresponding vertical tube 132 along a rotating direction R1 from a position as show in FIG. 4 to another position as shown in FIG. 5 via sliding movement of the corresponding pin component 144 within the corresponding inclined slot 1452. Each recovering component 146 is connected to the corresponding plunger component 145 for biasing the corresponding engaging component 143 to rotatably protrude from the corresponding vertical tube 132 along another rotating direction opposite to the rotating direction R1.

However, the structure and the configuration of the locking mechanism are not limited to this embodiment. For example, in another embodiment, the plunger component can be omitted, and the linking component is directly connected to the operating component and the engaging component.

Figure 6:
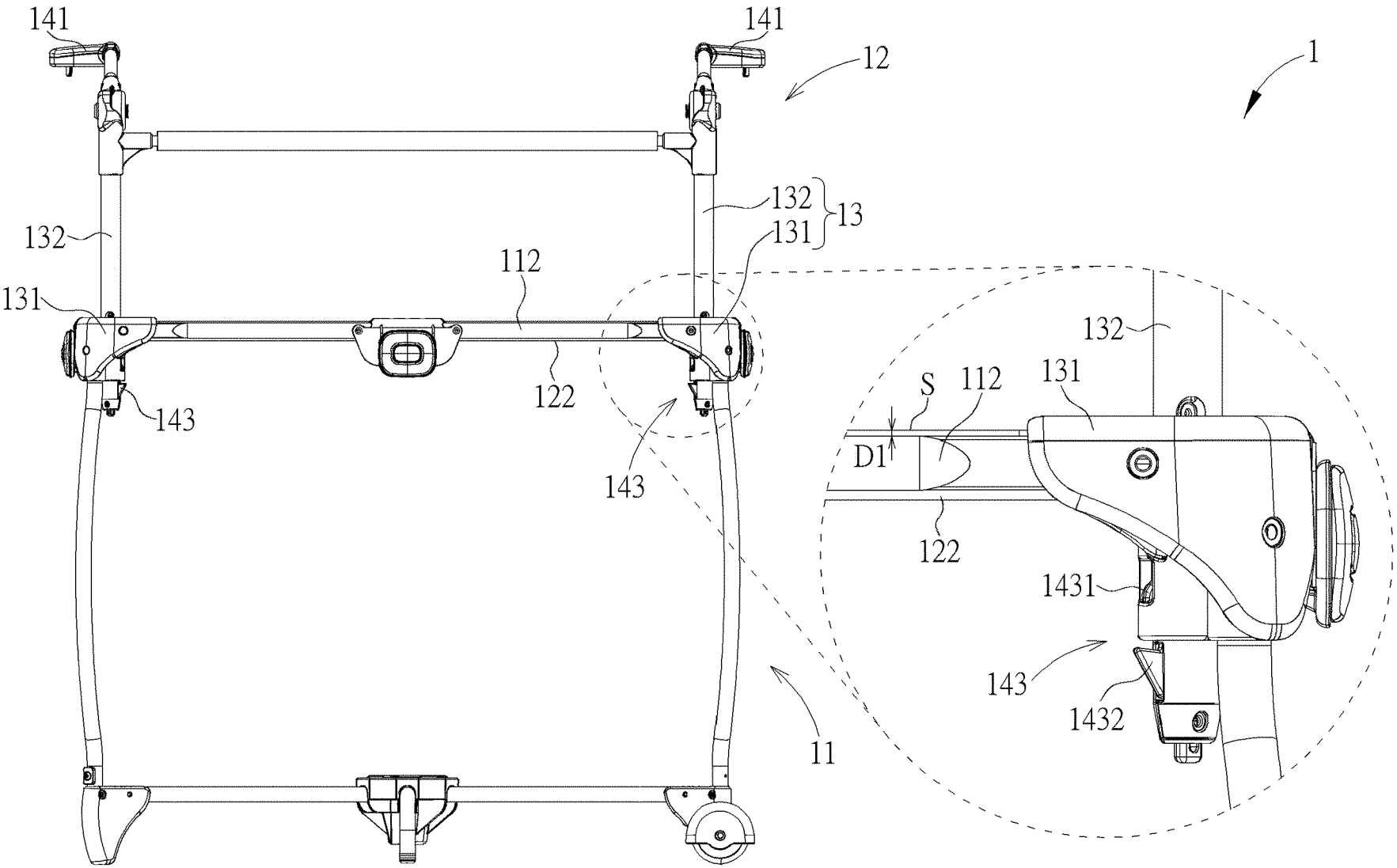
FIG. 6 is a diagram of the bassinet in a first using state according to the first embodiment of the present invention.
Figure 7:
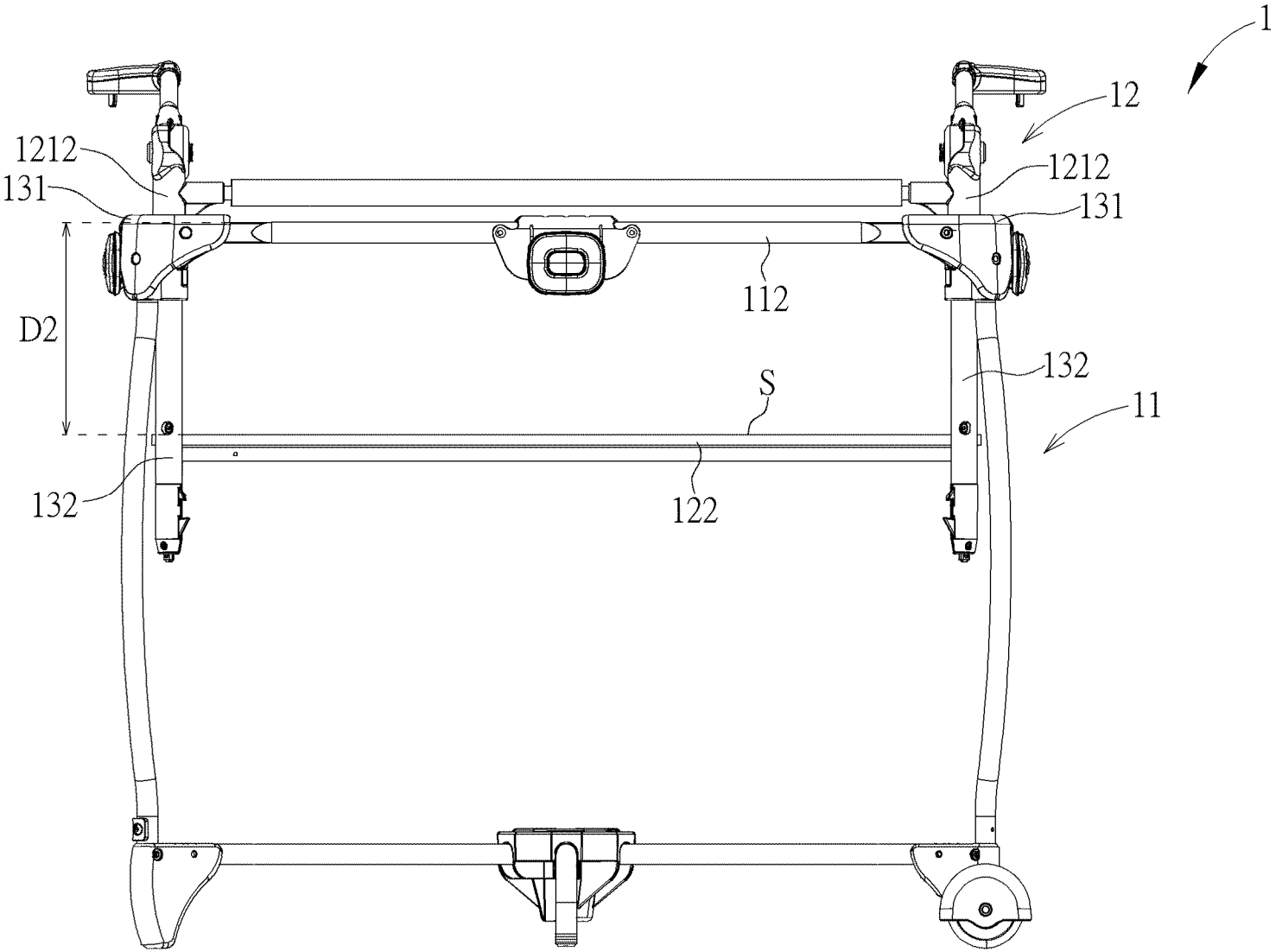
FIG. 7 is a diagram of the bassinet in a second using state according to the first embodiment of the present invention.
Figure 8:
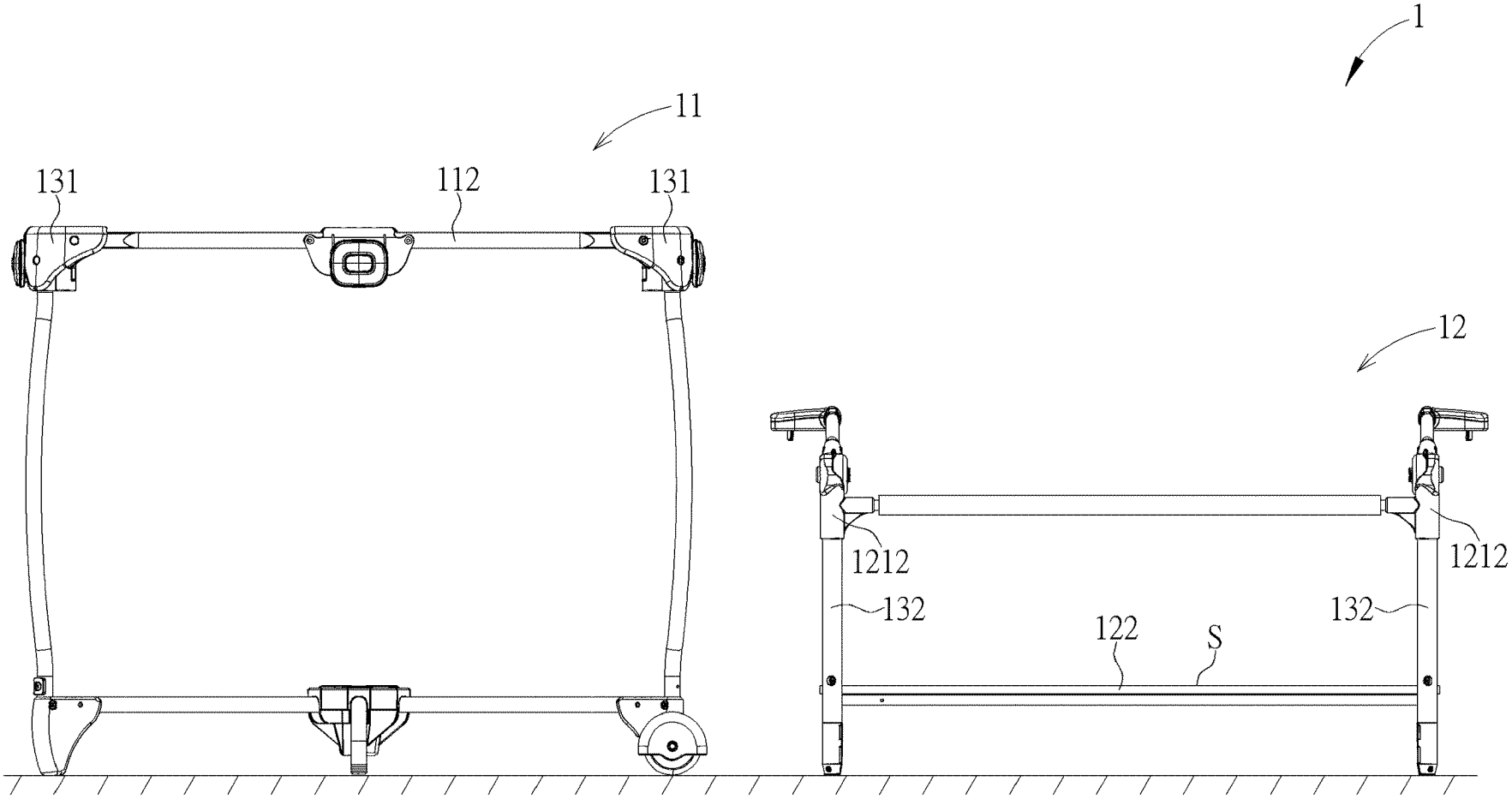
FIG. 8 is a diagram of the bassinet in a third using state according to the first embodiment of the present invention.

Please refer to FIG. 4 to FIG. 8. FIG. 6 is a diagram of the bassinet 1 in a first using state according to the first embodiment of the present invention. FIG. 7 is a diagram of the bassinet 1 in a second using state according to the first embodiment of the present invention. FIG. 8 is a diagram of the bassinet 1 in a third using state according to the first embodiment of the present invention. The bassinet 1 of the present invention has multiple purposes and can be used in different using states shown in FIG. 6 to FIG. 8. The operational principle of the bassinet 1 of the present invention is provided as follows. When it is desired to switch the bassinet 1 to the first using state as shown in FIG. 6, it is to install the bassinet frame 12 on the main frame 11 by passing the four vertical tubes 132 through the four sockets 131 for allowing the bassinet frame 12 to vertically move relative to the main frame 11. Afterwards, the two operating components 141 can be operated to drive the four plunger components 145 by the four linking components 142 to rotatably retract the four engaging components 143 into the four vertical tubes 132 along the rotating direction R1 from the position as shown in FIG. 4 to the position as shown in FIG. 5 for preventing interference between the four engaging components 143 and the four sockets 131 during vertical movement of the bassinet frame 12 relative to the main frame 11. Furthermore, the four recovering components 146 are compressed when the two operating components 141 are operated. When the bassinet frame 12 is vertically raised to a first position relative to the main frame 11 as shown in FIG. 6, the two operating components 141 can be released, so that the four compressed recovering components 146 can recover to drive the four plunger components 145 to rotatably protrude the four engaging components 143 from the four vertical tubes 132 to engage with the four sockets 131 for positioning the bassinet frame 12 relative to the main frame 11. At this moment, as shown in FIG. 6, the supporting surface S of the lower mounting component 122 of the bassinet frame 12 is adjacent to a top surface of the main frame 11, i.e., the four horizontal upper main tubes 112. Therefore, it provides an unhindered view of a child in the bassinet frame 12 and ensures the view of the child cannot be blocked by the main frame 11 or soft goods attached on the main frame 11. In this embodiment, as shown in FIG. 6, the supporting surface S can be located above the top surface of the main frame 11 and spaced from the top surface of the main frame 11 at a first distance D1. However, the present invention is not limited thereto. In another embodiment, the supporting surface S also can be located adjacent to the top surface of the main frame 11 and below the top surface of the main frame 11 at the first distance D1 or even be overlapped with the top surface of the main frame 11, i.e., the first distance D1 can be substantially equal to zero.

Furthermore, when it is desired to switch the bassinet 1 from the first using state as shown in FIG. 6 to the second using state as shown in FIG. 7, it is to operate the two operating components 141 to drive the four plunger components 145 by the four linking components 142 to rotatably retract the four engaging components 143 into the four vertical tubes 132 along the rotating direction R1 from the position as shown in FIG. 4 to the position as shown in FIG. 5 for disengaging the four engaging components 143 from the four sockets 131, so that the bassinet frame 12 is allowed to vertically move relative to the main frame 11. Afterwards, the bassinet frame 12 can be lowered relative to the main frame 11 until the four sleeve components 1212 abut against the four sockets 131. Furthermore, the two operating components 141 can be released after the vertical movement of the bassinet frame 12 relative to the main frame 11 is finished. When the four sleeve components 1212 abut against the four sockets 131, the bassinet frame 12 is positioned at a second position relative to the main frame 11 as shown in FIG. 7. At this moment, the supporting surface S of the lower mounting component 122 of the bassinet frame 12 is located below the top surface of the main frame 11 and spaced from the top surface of the main frame 11 at a second distance D2 greater than the first distance D1. In other words, the lower mounting component 122 of the bassinet located at the position as shown in FIG. 7 is further away from the top surface of the main frame 11 and lower than the lower mounting component 122 of the bassinet located at the position as shown in FIG. 6. Therefore, the bassinet in the second using state can be used as a normal bassinet.

Besides, when it is desired to switch the bassinet 1 from the first using state as shown in FIG. 6 or the second using state as shown in FIG. 7 to the third using state as shown in FIG. 8, it is to operate the two operating components 141 to drive the four plunger components 145 by the four linking components 142 to rotatably retract the four engaging components 143 into the four vertical tubes 132 for preventing the interference between the four engaging components 143 and the four sockets 131 during the vertical movement of the bassinet frame 12 relative to the main frame 11 or disengaging the four engaging components 143 from the four sockets 131, so that the bassinet frame 12 is allowed to be vertically detach from the main frame 11 by disengaging the four vertical tubes 132 and the four sockets 131. At this moment, the main frame 11 can be used as a play yard, and the bassinet frame 12 can be placed on the ground as a stand-alone bassinet. In other words, the bassinet frame 12 and the main frame 11 can be used as two independent child products. Furthermore, when the bassinet frame 12 is placed on the ground, the four plunger components 145 is forced to move toward an inner side of the vertical tube 132 by abutting of the ground and the four abutting ends 1451, so that the four engaging components 143 is driven by the four plunger components 145 to retract into the four vertical tubes 132 along the rotating direction R1 from the position as shown in FIG. 4 to the position as shown in FIG. 5, which improves aesthetic appearance and prevents the four engaging components 143 from sticking out dangerously.

Figure 9:
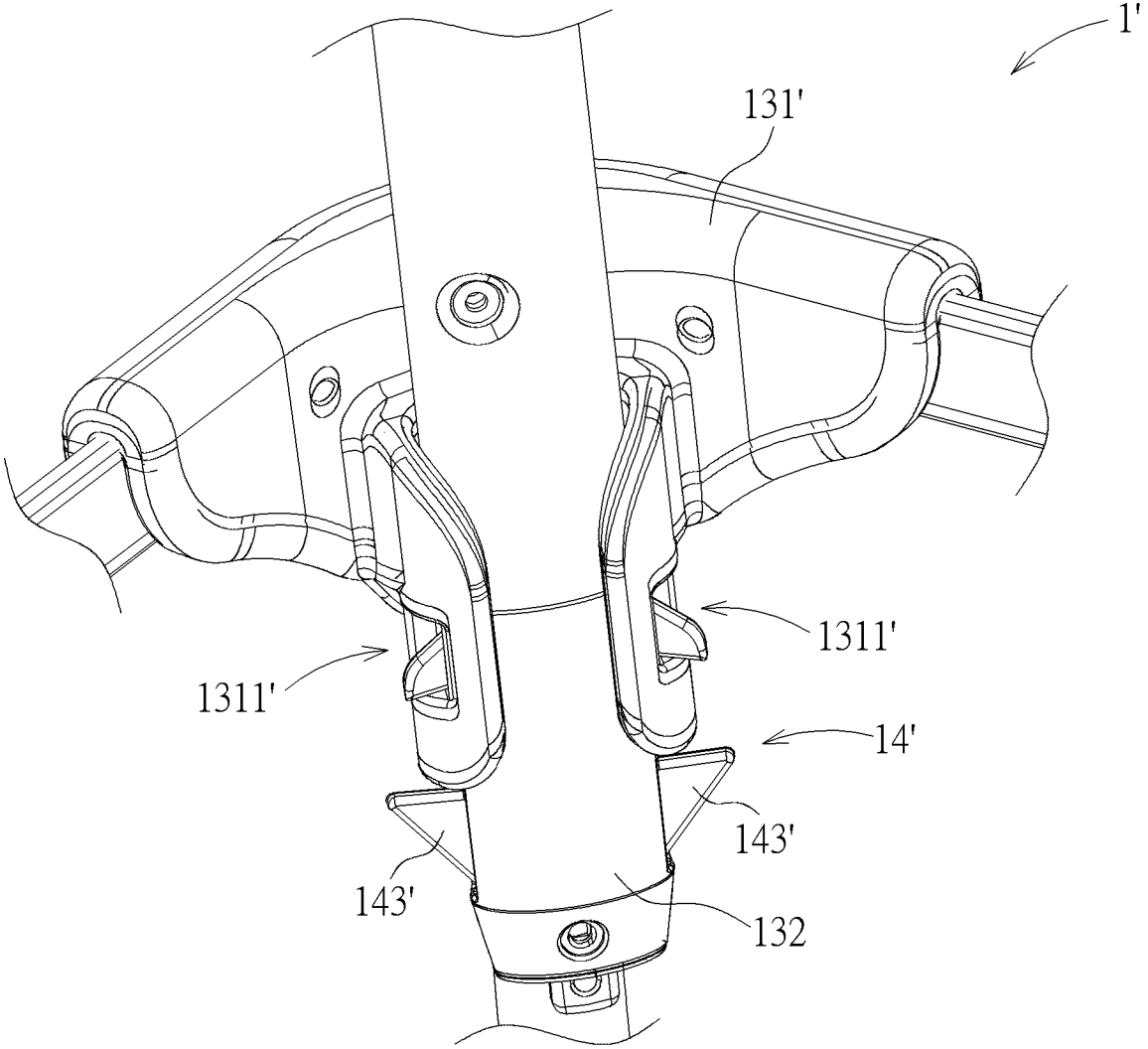
FIG. 9 is a partial diagram of a bassinet according to a second embodiment of the present invention.
Figure 10:
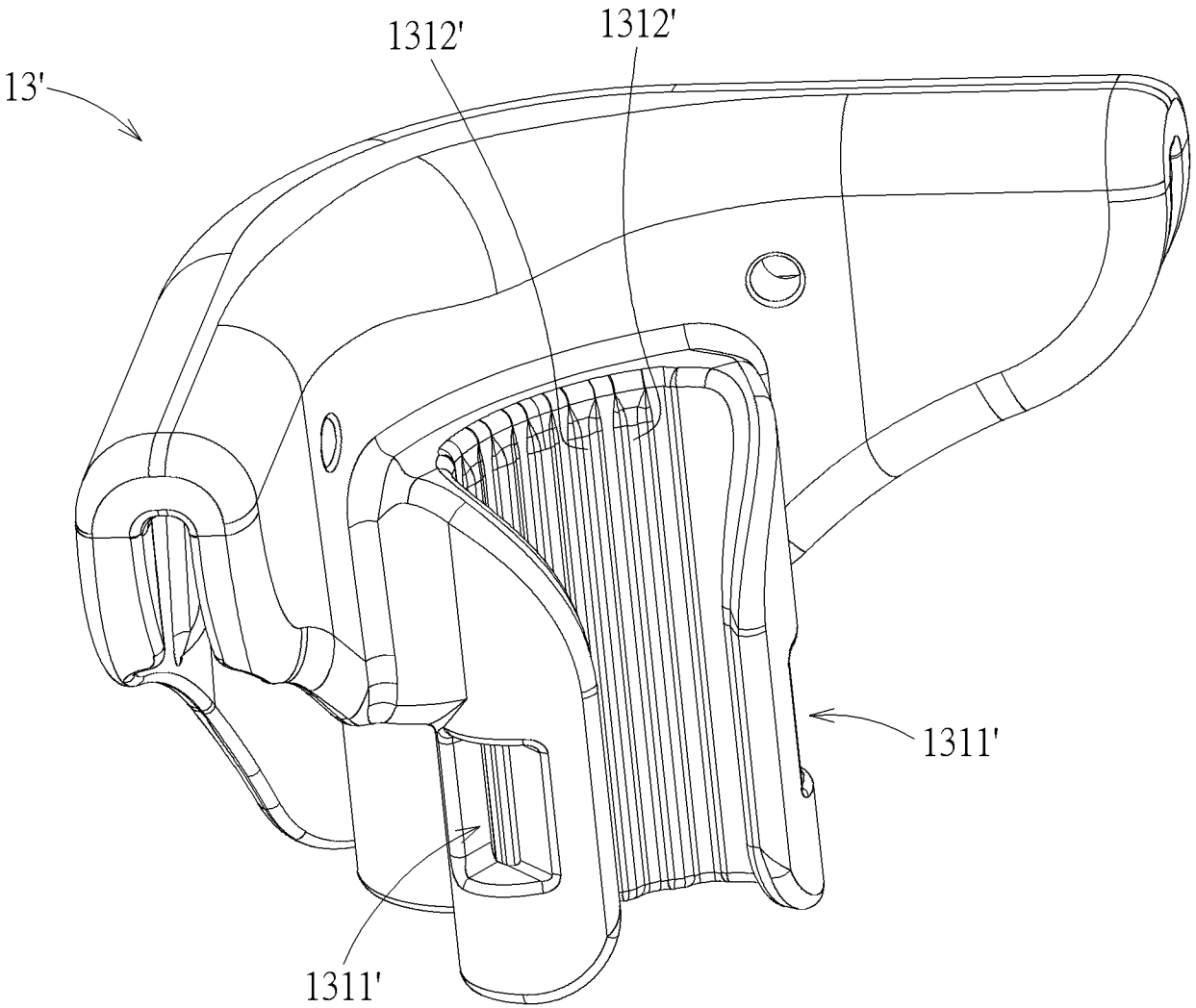
FIG. 10 is a diagram of a socket according to the second embodiment of the present invention.

Please further refer to FIG. 9 and FIG. 10. FIG. 9 is a partial diagram of a bassinet 1' according to a second embodiment of the present invention. FIG. 10 is a diagram of a socket 131' according to the second embodiment of the present invention. As shown in FIG. 9 and FIG. 10, the socket 131' is an open structure which is different from the enclosed socket 131 of the first embodiment. Two engaging holes 1311' are formed on two lateral portions of the socket 131'. A plurality of ribs 1312' is formed on an inner surface of the socket 131' to provide a tight tolerance fit. Each locking mechanism 14' of the second embodiment includes two engaging components 143' disposed inside the corresponding tube 132 for engaging with the socket 131'.

Figure 11:
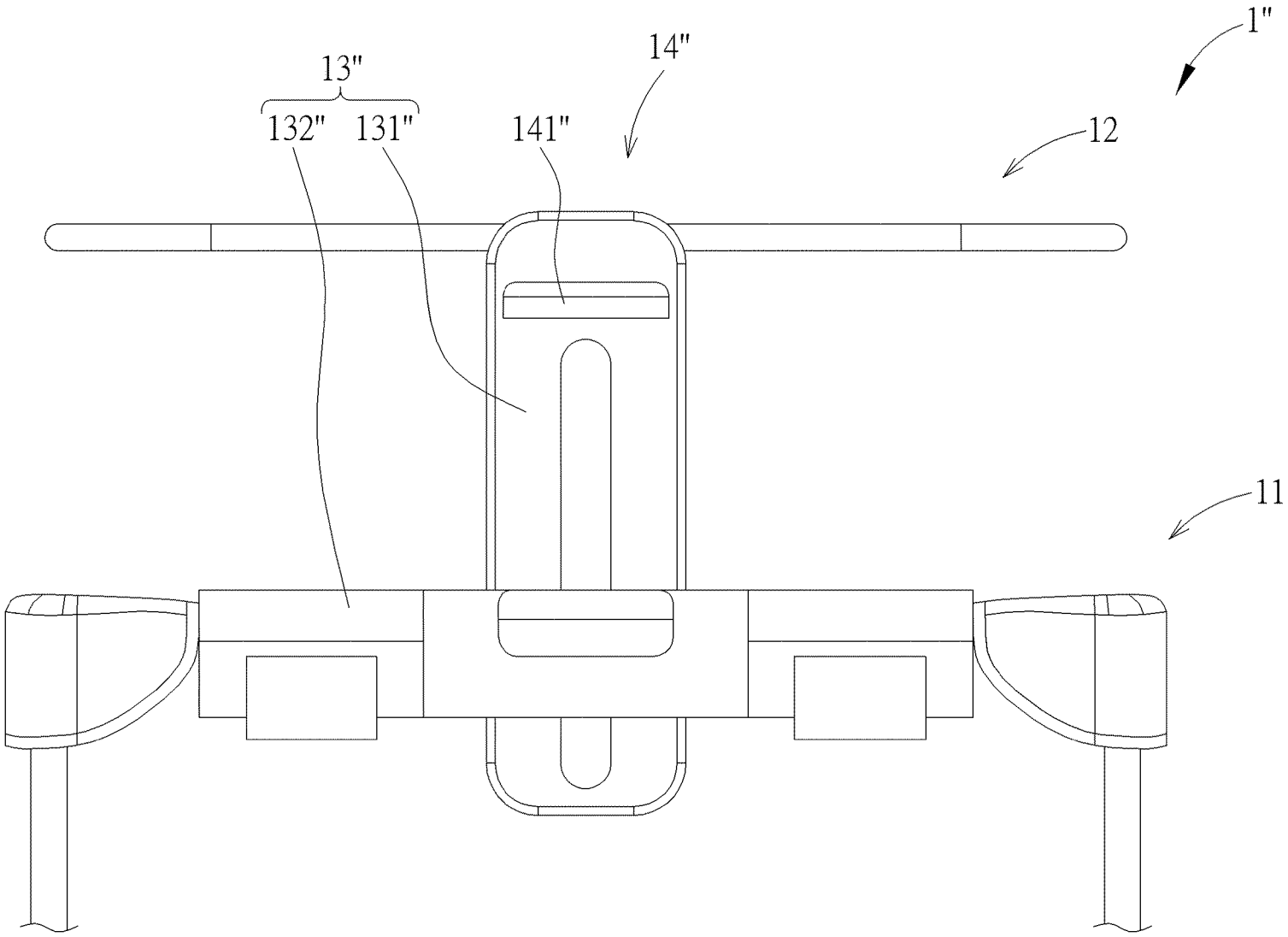
FIG. 11 and FIG. 12 are diagrams of a bassinet at different using states according to a third embodiment of the present invention.
Figure 12:
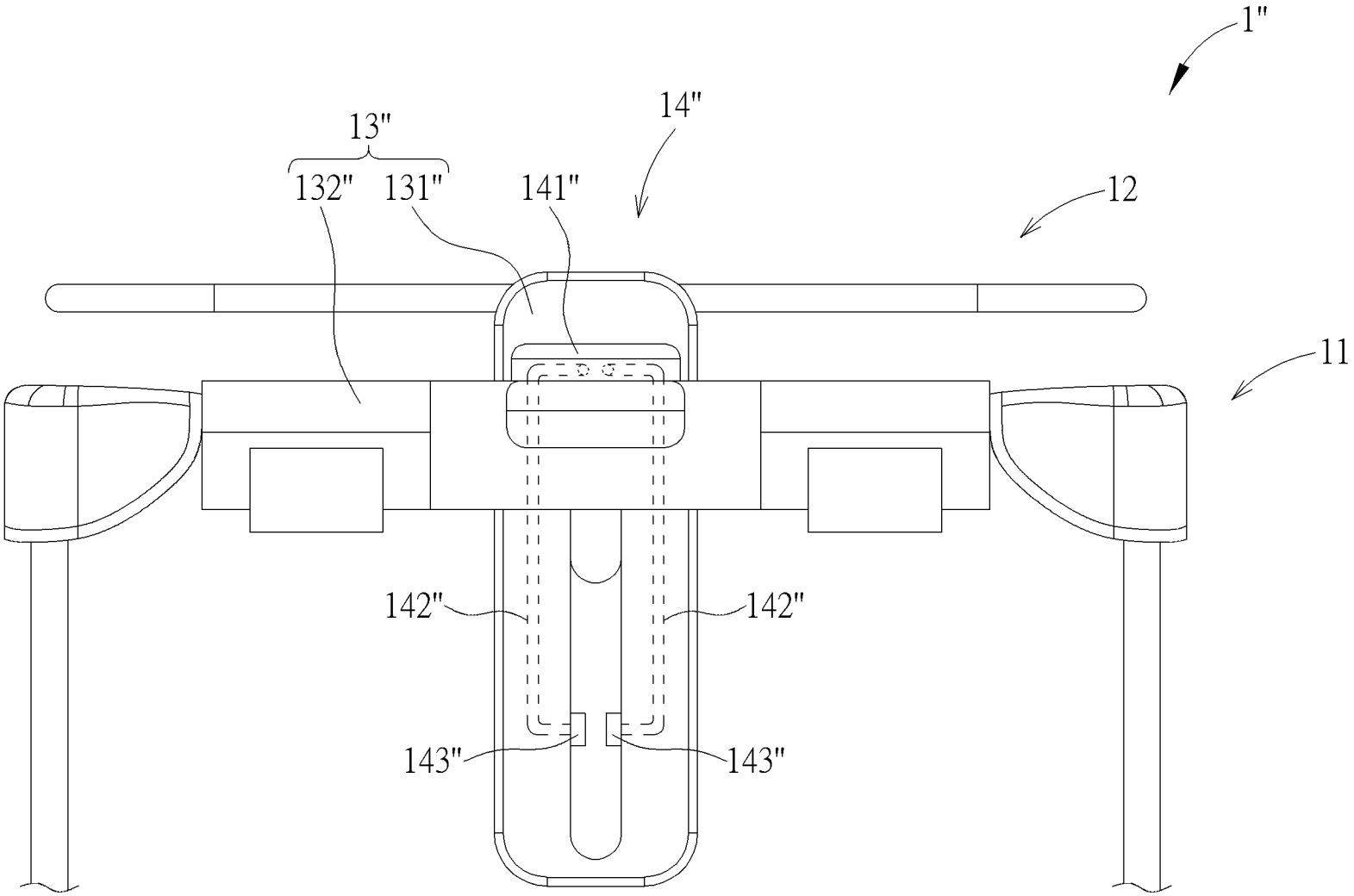

Please refer to FIG. 11 and FIG. 12. FIG. 11 and FIG. 12 are partial diagrams of a bassinet 1" at different using states according to a third embodiment of the present invention. As shown in FIG. 11 and FIG. 12, different from the aforementioned embodiments, the bassinet 1" of this embodiment includes a height adjusting assembly 13" and two locking mechanisms 14". The height adjusting assembly 13" includes two sliding tracks 131" disposed on the two opposite sides of the bassinet frame 12 and two adjusting housings 132" disposed on two opposite sides of the main frame 11 and corresponding to the two sliding tracks 131". The bassinet frame 12 is slidably installed on the main frame 11 by the two sliding tracks 131" and the two adjusting housings 132". Each locking mechanism 14" includes an operating component 141", two linking component 142" and two engaging components 143". The operating component 141" is disposed on the corresponding sliding track and for abutting against the corresponding adjusting housing 132". The two engaging components 143" are movably disposed on two opposite sides of the corresponding sliding track 131" for engaging with the corresponding adjusting housing 132" to position the bassinet frame 12 relative to the main frame 11. Each linking component 142" is connected to the corresponding operating component 141" and the corresponding engaging component 143" for driving the corresponding engaging component 143" by operating the corresponding operating component 141". As shown in FIG. 11, the bassinet frame 12 is positioned at the first position relative to the main frame 11 by engagement of the engaging components 143" and the adjusting housings 132". As shown in FIG. 12, the bassinet frame 12 is positioned at the second position relative to the main frame 11 by abutting of the operating components 141" and the adjusting housings 132".

In contrast to the prior art, the bassinet of the present invention can be switched between different using states by moving the bassinet frame relative to the main frame between the first position and the second position or detaching the bassinet frame from the main frame. When the bassinet frame is located at the first position, the supporting surface of the bassinet frame is adjacent to the top surface of the main frame, so that the bassinet provides an unhindered view of a child in the bassinet frame. Furthermore, the bassinet can be used as a normal bassinet when the bassinet frame is located at the second position. Besides, the main frame and the bassinet frame can be used as a standard play yard and a stand-alone bassinet when the bassinet frame is detached from the main frame. Therefore, the bassinet of the present invention has multiple purposes.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bassinet comprising:

a main frame comprising a top surface;

a bassinet frame detachably installed on the main frame, the bassinet frame being vertically movable between a first position and a second position relative to the main frame, the bassinet frame comprising a supporting surface for supporting a child, the supporting surface of the bassinet frame being adjacent to the top surface of the main frame and spaced from the top surface of the main frame at a first distance when the bassinet frame is located at the first position relative to the main frame, the supporting surface of the bassinet frame being below the top surface of the main frame and spaced from the top surface of the main frame at a second distance greater than the first distance when the bassinet frame is located at the second position relative to the main frame; and a height adjusting assembly comprising at least one sliding track immovably disposed on the bassinet frame, the bassinet frame being slidably installed on the main frame by the at least one sliding track, so that the bassinet frame is vertically slidable between the first position and the second position relative to the main frame by a vertical sliding movement of the at least one sliding track.

2. The bassinet of claim 1, wherein the bassinet further comprises at least one locking mechanism for positioning the bassinet frame at the first position or the second position.

3. The bassinet of claim 2, wherein the height adjusting assembly further comprises at least one adjusting housing disposed on the main frame, and the bassinet frame is slidably installed on the main frame by the at least one sliding track and the at least one adjusting housing, so that the bassinet frame is vertically slidable between the first position and the second position relative to the main frame by a vertical sliding movement of the at least one sliding track relative to the at least one adjusting housing.

4. The bassinet of claim 3, wherein the at least one locking mechanism comprises an operating component, a linking component, and an engaging component, the operating component is disposed on the at least one sliding track and for abutting against the at least one adjusting housing, the engaging component is movably disposed on a side of the at least one sliding track for engaging with the at least one adjusting housing to position the bassinet frame relative to the main frame, the linking component is connected to the operating component and the engaging component for driving the engaging component by operating the operating component, the bassinet frame is positioned at the first position relative to the main frame by engagement of the engaging component and the at least one adjusting housing, the bassinet frame is positioned at the second position relative to the main frame by abutting of the operating component and the at least one adjusting housing.

5. The bassinet of claim 1, wherein the height adjusting assembly further comprises at least one adjusting housing disposed on the main frame, and the bassinet frame is slidably installed on the main frame by the at least one sliding track and the at least one adjusting housing, so that the bassinet frame is vertically slidable between the first position and the second position relative to the main frame by a vertical sliding movement of the at least one sliding track relative to the at least one adjusting housing.

* * * * *